US007354528B2

(12) United States Patent
Cheng et al.

(10) Patent No.: US 7,354,528 B2
(45) Date of Patent: Apr. 8, 2008

(54) MAGNETORHEOLOGICAL FLUID COMPOSITIONS

(75) Inventors: Yang-Tse Cheng, Rochester Hills, MI (US); John C. Ulicny, Oxford, MI (US); Thomas A. Perry, Bruce Township, MI (US); Mark A. Golden, Washington, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 371 days.

(21) Appl. No.: 11/233,449

(22) Filed: Sep. 22, 2005

(65) Prior Publication Data

US 2007/0063167 A1 Mar. 22, 2007

(51) Int. Cl.
*H01F 1/44* (2006.01)

(52) U.S. Cl. ..... 252/62.52

(58) Field of Classification Search ..... 252/62.52
See application file for complete search history.

(56) References Cited

U.S. PATENT DOCUMENTS

| | | | | |
|---|---|---|---|---|
| 5,525,249 | A * | 6/1996 | Kordonsky et al. | 252/62.56 |
| 6,032,772 | A | 3/2000 | Moser et al. | 192/21.5 |
| 6,173,823 | B1 | 1/2001 | Moser et al. | 192/21.5 |
| 6,318,531 | B1 | 11/2001 | Usoro et al. | 192/21.5 |
| 6,619,453 | B2 | 9/2003 | Stretch | 192/21.5 |
| 6,634,344 | B2 | 10/2003 | Stretch | 123/559.3 |
| 2006/0033068 | A1 * | 2/2006 | Cheng et al. | 252/62.52 |
| 2006/0033069 | A1 * | 2/2006 | Ulicny et al. | 252/62.52 |

* cited by examiner

*Primary Examiner*—C. Melissa Koslow

(57) ABSTRACT

A magnetorheological fluid composition comprising a low aspect ratio magnetizable particle comprising a unimodal particle distribution and an aspect ratio less than 1.5, a high aspect ratio magnetizable particle comprising an aspect ratio greater than 1.5, and a carrier fluid.

19 Claims, 2 Drawing Sheets

MAGNETORHEOLOGICAL FLUID COMPOSITIONS

BACKGROUND

This disclosure relates to magnetorheological fluid compositions, and more particularly to high yield stress magnetorheological (MR) fluid compositions. The high yield stress fluid compositions generally include high aspect ratio magnetizable particles and low aspect ratio magnetizable particles disposed in a carrier fluid.

Fluid compositions that undergo a change in apparent viscosity in the presence of a magnetic field are referred to as Bingham magnetic fluids or magnetorheological fluids. Magnetorheological fluids generally include low aspect ratio magnetizable particles dispersed or suspended in a carrier fluid. In the presence of a magnetic field, the low aspect magnetizable particles become polarized and are thereby organized into chains of particles or particle fibrils within the carrier fluid. The chains of particles act to increase the apparent viscosity or flow resistance of the fluid composition resulting in the development of a solid mass having a yield stress that must be exceeded to induce onset of flow of the magnetorheological fluid. When the flow of the fluid composition is restricted as a result of orientation of the particles into chains, the fluid composition is said to be in its "on state". The force required to exceed the yield stress is referred to as the "yield strength". In the absence of a magnetic field, the particles return to a disorganized or free state and the apparent viscosity or flow resistance of the fluid composition is then correspondingly reduced. The state occupied by the composition in the absence of a magnetic field is referred to as the "off-state".

Commonly used magnetorheological fluids generally employ low aspect magnetizable particles that are symmetrical and have aspect ratios of 1 to 1.5. Examples of such particles are spherical particles, ellipsoids, cuboids, or the like. With reference now to FIG. 1, a typical prior art MR fluid device 10 contains an MR fluid composition 12 consisting of low aspect ratio particles 14 and a carrier fluid 16. As can be seen in FIG. 1, the low aspect ratio particles 14 form chains in the direction of an applied magnetic field 18. The formation of the chains promotes a selective increase in viscosity. Magnetorheological fluids employing the aforementioned particles are used in devices or systems for controlling vibration and/or noise. For example, magnetorheological fluids employing the aforementioned particles are utilized to provide controllable forces that can act upon a piston in linear devices such as dampers or mounts. In these applications, the magnetorheological fluid can be subjected to shear forces greater than or equal to about 70 kilo Pascals (kPa), at shear rates of about 1,000 to about 50,000 $sec^{-1}$ causing extreme wear on the magnetizable particles. As a result of this wear, the magnetorheological fluid thickens substantially over time, leading to an increasing off-state viscosity. The increasing off-state viscosity leads to an increase in off-state force experienced by the piston or rotor. This increase in off-state force hampers the freedom of movement of the piston or rotor in certain off-state conditions.

In a magnetorheological device, it is often desirable to maximize the ratio of the on-state force to the off-state force in order to maximize the controllability offered by the device. Since the on-state force is dependent upon the magnitude of the applied magnetic field, the on-state force should remain constant at any given applied magnetic field. If the off-state force increases over time because the off-state viscosity is increasing but the on-state force remains constant, the on-state/off-state ratio will decrease. This decrease in the on-state/off-state ratio results in undesirable minimization of the controllability offered by the device. A more durable magnetorheological fluid that does not thicken over an extended period of time, preferably over the life of the device would be very useful. Moreover, it is desirable to minimize the costs of the MR fluid composition. Low aspect ratio magnetizable particles are relatively expensive to manufacture.

Accordingly, there is a need for improved MR fluid compositions suitable for high yield stress applications that are relatively less expensive.

SUMMARY

Disclosed herein is a low aspect ratio magnetizable particle comprising a unimodal particle distribution and an aspect ratio from 1 to less than 1.5; a high aspect ratio magnetizable particle comprising an aspect ratio greater than 1.5; and a carrier fluid.

In another embodiment, a magnetorheological fluid composition comprises a low aspect ratio magnetizable particle comprising a bimodal particle distribution and an aspect ratio from 1 to less than 1.5; a high aspect ratio magnetizable particle comprising an aspect ratio greater than 1.5, a length from 1 to 10 millimeters and a diameter of 0.1 to 1 mm; a fumed silica; and a carrier fluid.

The above described and other features are exemplified by the following figures and detailed description.

DETAILED DESCRIPTION

Figure 1:
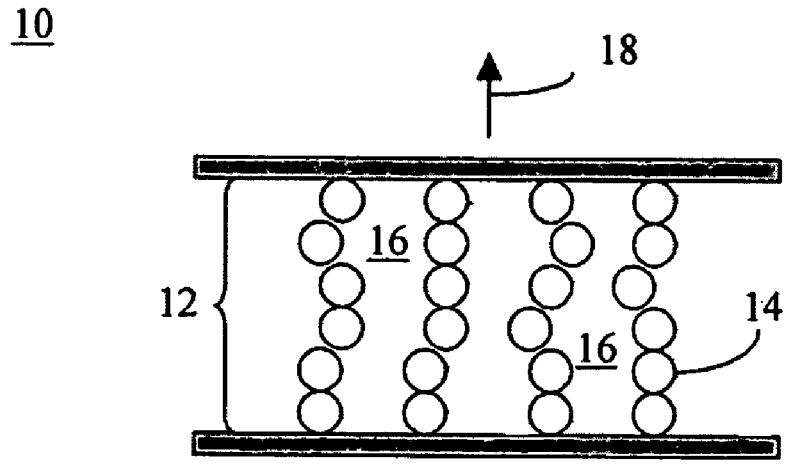
(PRIOR ART) Figure 1
FIG. 1 is a schematic of a prior art MR fluid composition consisting of low aspect low aspect ratio magnetizable particles that form chains upon the application of a magnetic field.
Figure 2:
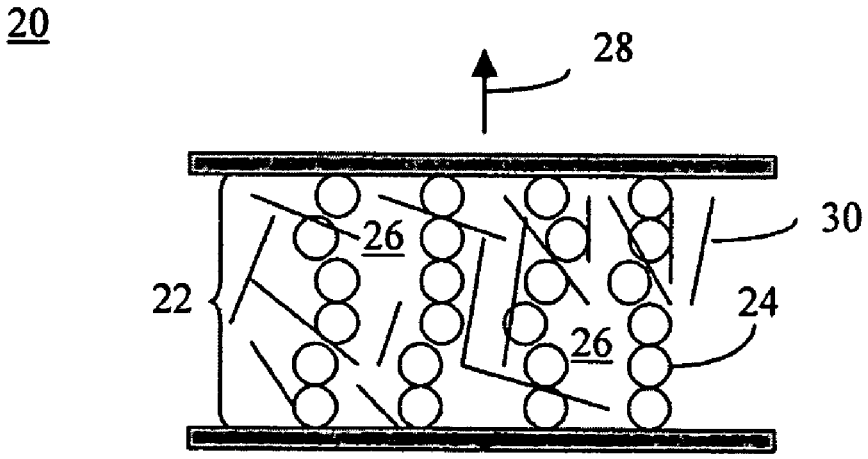
FIG. 2 is a schematic of a MR fluid composition including high and low aspect low aspect ratio magnetizable particles that form chains upon the application of a magnetic field.

Referring now to FIG. 2, a MR fluid composition 22 in accordance with the present disclosure and suitable for use in a device 20 comprises high aspect ratio magnetizable particles 30 and low aspect ratio magnetizable particles 24 in a carrier fluid 26 that generally align in the direction of an applied magnetic field 28. The high aspect ratio magnetizable particles have an aspect ratio greater than 1.5 and the low aspect ratio magnetizable particles have an aspect ratio of 1 to less than 1.5. In addition to an aspect ratio greater than 1.5, the high aspect ratio magnetizable particles have a length of about 1 to about 10 millimeters (mm) and a diameter of about 0.1 to about 1 mm. It has been found that the use of these high aspect ratio magnetizable particles increases the field response effect as compared to MR fluid compositions consisting of only low aspect ratio magnetizable particles.

In one embodiment, the high aspect ratio magnetizable particles comprise machining chips although other sources for the particles are equally suitable. The term "machining chips" is to be accorded its ordinary and usual meaning, and includes, but is not intended to be limited, magnetizable shavings and chips obtained by a cutting tool applied to a magnetizable material. One advantage from the use of machining chips, among others, is that the machining chips are relatively inexpensive compared to low aspect ratio carbonyl powders, for example. The machining chips can be formed from relatively inexpensive magnetic materials such as cast iron, for example. By way of comparison, machining chips formed from cast iron have an estimated cost of about $0.70 per pound whereas conventional carbonyl iron powders typically cost about $6 per pound. Thus, the addition of the high aspect ratio magnetizable particles at the aforementioned dimensions can not only provide increased responsiveness but also a significant commercial advantage. Alternatively, the machining chips can be formed from magnetic alloys to provide even greater magnetization than more traditional materials such as low aspect ratio water atomized carbonyl iron powders having dimensions that are about three orders of magnitude smaller.

A lathe or like machine can be used as a suitable cutting tool to produce the machine chips from any magnetizable material or magnetic alloy. As will be appreciated by those in the art, the desired length (1 to 10 mm) can be obtained as a function of the depth of cut whereas the desired diameter (0.1 to 1 mm) can be obtained as a function of the rate of feed and geometry of the cutting tool.

In one embodiment, the low aspect ratio magnetizable particles comprise a bimodal particle distribution (i.e., bimodal low aspect ratio magnetizable particles). As used herein, the term "bimodal" generally refers to a particle distribution that has two maximums. While not wanting to be bound by theory, it is believed the use of the bimodal low aspect ratio magnetizable particles with the high aspect ratio magnetizable particles as described herein provides an increase in yield strength as a result of a higher packing density of the particles within the carrier fluid or the MR fluid composition at a reduced particle volume formulation can be formulated to approximate the yield stress properties of a conventional MR fluid composition consisting of only low aspect ratio magnetizable particles. An increased yield stress is an enabler for applications where higher yield stress is required but not yet available, provides the opportunity to reduce the size of a device employing the MR fluid composition, and provides the opportunity to reduce the particle volume fraction while maintaining the same on-state yield stress, all of which will provide a lower off-state drag, improve overall operating efficiency, and reduce MR fluid costs.

The high aspect ratio particles can function as bridges and can contact the chains of the low aspect ratio particles, thereby increasing the yield stress of the MR fluid composition in the on-state. The high aspect ratio particles contact the low aspect ratio particles or a chain of low aspect ratio particles to create a chain of particles or a network of particles that can increase the viscosity at lower magnetic field strengths when compared with a MR fluid composition that contains only low aspect ratio particles. The increase in viscosity can be advantageously achieved with a smaller number of total magnetizable particles in the high aspect ratio MR fluid composition when compared with a MR fluid composition that contains only low aspect ratio particles. Since the increase in viscosity can be achieved with a smaller number of magnetizable particles, MR devices can be reduced in size when compared with prior art devices.

One advantage of MR fluid compositions is that the yield stress of the MR fluid composition can be 2 to 10 times higher or more when compared with MR fluid compositions containing low aspect ratio particles alone. This feature, in turn, will allow the production of MR fluid devices that are smaller but produce the same level of force as produced by larger devices that contain MR fluids with only low aspect ratio particles. Thus, MR fluids containing the high aspect ratio particles and low aspect ratio magnetizable particles can be used to build devices that are either more powerful and/or smaller than those devices that use MR fluids with only low aspect ratio particles. Also, since high aspect particles will align themselves with the flow field in shear when no magnetic field is present, MR fluid compositions containing the high aspect ratio magnetizable particles will exhibit lower apparent viscosities as compared to compositions containing only low aspect ratio particles.

Since fewer magnetizable particles can be used in the MR fluid composition, the composition can have a lower viscosity in the off-state, thereby offering a better on-state to off-state ratio and hence greater sensitivity when compared with MR fluid composition that contains only low aspect ratio particles. In addition, the decrease in the reduction of the on-state to off-state ratio is minimized resulting in improved long term controllability of the device.

By using the high aspect ratio magnetizable particles in addition to the low aspect ratio magnetizable particles higher yield stress properties can be obtained or lower amounts of particles (i.e., a reduction in the particle volume fraction) can be used to achieve the same effect. Further gains can be obtained by using low aspect ratio magnetizable particles having the bimodal particle size distribution.

In one embodiment, the high aspect ratio magnetizable particles are formed from cast iron and the low aspect ratio magnetizable particles are formed from water atomized carbonyl iron powder disposed in a synthetic hydrocarbon based oil.

The magnetizable particles of the MR fluid composition are comprised of, for example, paramagnetic, superparamagnetic, ferromagnetic compounds, or a combination comprising at least one of the foregoing compounds. Examples of specific magnetizable particles are particles comprised of materials such as iron, iron oxide, iron nitride, iron carbide, carbonyl iron, chromium dioxide, low carbon steel, silicon steel, nickel, cobalt, or the like, or a combination comprising at least one of the foregoing. The iron oxide includes all forms of pure iron oxide, such as, for example, $Fe_2O_3$ and $Fe_3O_4$, as well as those containing small amounts of other elements, such as, manganese, zinc or barium. Specific examples of iron oxide include ferrites and magnetites. In addition, the magnetizable particles can be comprised of alloys of iron, such as, for example, those containing aluminum, silicon, cobalt, nickel, vanadium, molybdenum, chromium, tungsten, manganese, copper, or a combination comprising at least one of the foregoing metals.

The magnetizable component can also be comprised of the specific iron-cobalt and iron-nickel alloys. The iron-cobalt alloys have an iron to cobalt ratio ranging from about 30:70 to about 95:5. In one embodiment, the iron-cobalt alloys can have an iron to cobalt ratio ranging from about 50:50 to about 85:15. The iron-nickel alloys have an iron to nickel ratio ranging from about 90:10 to about 99:1. In one embodiment, the iron-nickel alloys can have an iron to cobalt ratio ranging from about 94:6 to about 97:3. The aforementioned iron-cobalt and iron-nickel alloys may also contain a small amount of additional elements, such as, for example, vanadium, chromium, or the like, in order to improve the ductility and mechanical properties of the alloys. These additional elements are typically present in an amount that is less than about 3.0% by weight, based on the total weight of the magnetizable particles.

In still another embodiment, the magnetizable component can be comprised of non-magnetic ceramic and polymeric fibers that include coatings of a magnetic material or a magnetic material attached thereto.

The low aspect ratio magnetizable particles are generally obtained from processes involving the reduction of metal oxides, grinding or attrition, electrolytic deposition, metal carbonyl decomposition, rapid solidification, or smelt processing. Examples of suitable metal powders that are commercially available are straight iron powders, reduced iron powders, insulated reduced iron powders, cobalt powders, or the like, or a combination comprising at least one of the foregoing metal powders. Alloy powders can also be used. A suitable example of an alloy powder is one comprising 48 wt % iron, 50 wt % cobalt and 2 wt % vanadium from UltraFine Powder Technologies. Exemplary magnetizable particles are those that contain a majority of iron in any one of its chemically available forms. Carbonyl iron powders that are made by the thermal decomposition of iron pentacarbonyl are generally desirable for forming the low aspect ratio magnetizable particles.

The low aspect ratio magnetizable particles that have a bimodal low aspect ratio generally have an aspect ratio of about 1 to 1.5. An exemplary low aspect ratio particle is one that has an aspect ratio of about 1. Examples of suitable low aspect ratio particles are spherical, ellipsoidal, conical, cuboidal, polygonal, or the like. These magnetizable particles that have a low aspect ratio generally have an average particle size of about 0.1 micrometers to about 500 micrometers. In one embodiment, the magnetizable particles that have a spherical shape generally have an average particle size of about 1 micrometer to about 250 micrometers. In another embodiment, the magnetizable particles that have a spherical shape generally have an average particle size of about 10 micrometers to about 100 micrometers. In yet another embodiment, the magnetizable particles that have a spherical shape generally have an average particle size of about 20 micrometers to about 80 micrometers.

The high aspect ratio magnetizable particles are those having an aspect ratio of greater than 1.5. In another embodiment, the aspect ratio of the high aspect ratio magnetizable particles is greater than 20. In another embodiment, the aspect ratio of the high aspect ratio magnetizable particles is greater than 100. In yet another embodiment, the aspect ratio of the high aspect ratio magnetizable particles is greater than 1,000. In yet another embodiment, the aspect ratio of the high aspect ratio magnetizable particles is greater than 10,000. These high aspect ratio magnetizable particles may therefore exist in the form of whiskers, needles, rods, tubes, strands, elongated platelets, lamellar platelets, ellipsoids, wires, micro fibers, nanofibers and nanotubes, elongated fullerenes, or the like, or a combination comprising at least one of the foregoing.

For the high aspect ratio magnetizable particles, it is preferred that they are obtained from machining a magnetizable material, e.g., such as by lathe cutting of a cast iron blank. In general, the high aspect ratio magnetizable particles can have cross sections that have any desirable geometry. Examples of suitable geometries are square, rectangular, triangular, circular, elliptical, polygonal, or a combination comprising at least one of the foregoing geometries.

The weight ratio of the high aspect ratio magnetizable particles to the low aspect ratio magnetizable particles is about 100:1 to about 1:100. In one embodiment, the weight ratio of the high aspect ratio magnetizable particles to the low aspect ratio magnetizable particles is about 75:1 to about 1:75. In another embodiment, the weight ratio of the high aspect ratio magnetizable particles to the low aspect ratio magnetizable particles is about 50:1 to about 1:50. In yet another embodiment, the weight ratio of the high aspect ratio magnetizable particles to the low aspect ratio magnetizable particles is about 25:1 to about 1:25. An exemplary weight ratio of the high aspect ratio magnetizable particles to the low aspect ratio magnetizable particles is about 1:4.

The number of magnetizable particles in the high aspect ratio MR fluid composition depends upon the desired magnetic activity and viscosity of the fluid, but can be from about 5 to about 60 volume percent based on the total volume of the MR fluid composition. In another embodiment, the number of magnetizable particles in the high aspect ratio MR fluid composition is about 15 to about 50 volume percent based on the total volume of the MR fluid composition.

The carrier fluid forms the continuous phase of the MR fluid composition. Examples of suitable carrier fluids are natural fatty oils, mineral oils, poly α-olefins, polyphenylethers, polyesters (such as perfluorinated polyesters, dibasic acid esters and neopentylpolyol esters), phosphate esters, synthetic cycloparaffin oils and synthetic paraffin oils, unsaturated hydrocarbon oils, monobasic acid esters, glycol esters and ethers (such as polyalkylene glycol), synthetic hydrocarbon oils, perfluorinated polyethers, halogenated hydrocarbons, or the like, or a combination comprising at least one of the foregoing carrier fluids. In a preferred embodiment, the carrier is a synthetic hydrocarbon based oil.

Exemplary carrier fluids are those which are non-volatile, non-polar and do not contain amounts of water greater than or equal to about 5 wt %, based upon the total weight of the carrier fluid. Examples of hydrocarbons are mineral oils, poly-alpha olefins, paraffins, or cycloparaffins. Synthetic hydrocarbon oils include those oils derived from oligomerization of olefins such as polybutenes and oils derived from high molecular weight alpha olefins having about 8 to about 20 carbon atoms by acid catalyzed dimerization and by oligomerization using trialuminum alkyls as catalysts.

The carrier fluid is generally present in an amount of about 50 to about 95 volume percent, based upon the total volume of high aspect ratio MR fluid composition. In one embodiment, the carrier fluid is generally present in an amount ranging from about 65 to about 80 volume percent, based upon the total volume of the MR fluid composition.

The MR fluid composition can optionally include other additives such as a thixotropic agent, a carboxylate soap, an antioxidant, a lubricant, a viscosity modifier, a suspending agent, a sulfur-containing compound or a combination comprising at least one of the foregoing additives. If present, these optional additives can be present in an amount of about 0.25 to about 10 volume percent, based upon the total volume of the magnetorheological fluid. In one embodiment, these optional additives can be present in an amount of about 0.5 to about 7.5 volume percent, based upon the total volume of the magnetorheological fluid.

Exemplary thixotropic agents include polymer-modified metal oxides. The polymer-modified metal oxide can be prepared by reacting a metal oxide powder with a polymeric compound that is compatible with the carrier fluid and capable of shielding substantially all of the hydrogen-bonding sites or groups on the surface of the metal oxide from any interaction with other molecules. Examples of suitable metal oxide powders include precipitated silica gel, fumed or pyrogenic silica, silica gel, titanium dioxide, and iron oxides such as ferrites or magnetites, or the like, or a combination comprising at least one of the foregoing metal oxide powders.

Examples of suitable polymeric compounds useful in forming the polymer-modified metal oxides include thermosetting polymers, thermoplastic polymers or combinations of thermosetting polymers with thermoplastic polymers. Examples of polymeric compounds are oligomers, polymers, copolymers such as block copolymers, star block copolymers, terpolymers, random copolymers, alternating copolymers, graft copolymers, or the like, dendrimers, ionomers, or the like, or a combination comprising at least one of the foregoing. Examples of suitable polymers are polyacetals, polysiloxanes, polyurethanes, polyolefins, polyacrylics, polycarbonates, polyalkyds, polystyrenes, polyesters, polyamides, polyaramides, polyamideimides, polyarylates, polyarylsulfones, polyethersulfones, polyphenylene sulfides, polysulfones, polyimides, polyetherimides, polytetrafluoroethylenes, polyetherketones, polyether etherketones, polyether ketone ketones, polybenzoxazoles, polyoxadiazoles, polybenzothiazinophenothiazines, polybenzothiazoles, polypyrazinoquinoxalines, polypyromellitimides, polyquinoxalines, polybenzimidazoles, polyoxindoles, polyoxoisoindolines, polydioxoisoindolines, polytriazines, polypyridazines, polypiperazines, polypyridines, polypiperidines, polytriazoles, polypyrazoles, polycarboranes, polyoxabicyclononanes, polydibenzofurans, polyphthalides, polyacetals, polyanhydrides, polyvinyl ethers, polyvinyl thioethers, polyvinyl alcohols, polyvinyl ketones, polyvinyl halides, polyvinyl nitriles, polyvinyl esters, polysulfonates, polysulfides, polythioesters, polysulfones, polysulfonamides, polyureas, polyphosphazenes, polysilazanes, polysiloxanes, phenolics, epoxies, or combinations comprising at least one of the foregoing organic polymers.

An exemplary suspending agent is a polymer-modified metal oxide in the form of fumed silica treated with a siloxane oligomer.

Examples of the carboxylate soap include lithium stearate, calcium stearate, aluminum stearate, ferrous oleate, ferrous stearate, zinc stearate, sodium stearate, strontium stearate, or the like, or a combination comprising at least one of the foregoing carboxylate soaps.

Examples of sulfur-containing compounds include thioesters such as tetrakis thioglycolate, tetrakis(3-mercaptopropionyl) pentaerithritol, ethylene glycoldimercaptoacetate, 1,2,6-hexanetriol trithioglycolate, trimethylol ethane tri(3-mercaptopropionate), glycoldimercaptopropionate, bisthioglycolate, trimethylolethane trithioglycolate, trimethylolpropane tris(3-mercaptopropionate) and similar compounds and thiols such as 1-dodecylthiol, 1-decanethiol, 1-methyl-1-decanethiol, 2-methyl-2-decanethiol, 1-hexadecylthiol, 2-propyl-2-decanethiol, 1-butylthiol, 2-hexadecylthiol, or the like, or a combination comprising at least one of the foregoing sulfur-containing compounds The viscosity of the MR fluid composition is dependent upon the specific use to which it is applied. In general, it is desirable for the MR fluid composition to have a viscosity of about 1 to about 1000 Pascal-seconds at 40° C. in the off-state. In one embodiment, it is desirable for the MR fluid composition to have a viscosity of about 10 to about 700 Pascal-seconds at 40° C. in the off-state. In yet another embodiment, it is desirable for the MR fluid composition to have a viscosity of about 50 to about 600 Pascal-seconds at 40° C. in the off-state. In yet another embodiment, it is desirable for the MR fluid composition to have a viscosity of about 90 to about 400 Pascal-seconds at 40° C. in the off-state.

In general, it is desirable for the MR fluid composition to have a viscosity of about 2 to about 10 times the viscosity relative to a prior art MR fluid composition that contains only low aspect ratio particles, when in the on-state at 40° C. In one embodiment, it is desirable for the MR fluid composition to have a viscosity of about 3 to about 8 times the viscosity of the prior art MR fluid composition that contains only low aspect ratio particles, when in the on-state at 40° C. In one embodiment, it is desirable for the MR fluid composition to have a viscosity of about 4 to about 7 times the viscosity of the prior art MR fluid composition that contains only low aspect ratio particles, when in the on-state at 40° C.

A method of manufacturing the high aspect ratio MR fluid composition includes mixing the bimodal low aspect ratio particles, the high aspect ratio particles, the carrier fluid and desired additives in a suitable mixing device to form a suitable mixture. If desired, mixing may be conducted at an elevated temperature of greater than or equal to about 50° C. The mixing can take place in a device that uses shear force, extensional force, compressive force, ultrasonic energy, electromagnetic energy, thermal energy or combinations comprising at least one of the foregoing forces and energies and is conducted in processing equipment wherein the aforementioned forces are exerted by a single screw, multiple screws, intermeshing co-rotating or counter rotating screws, non-intermeshing co-rotating or counter rotating screws, reciprocating screws, screws with pins, barrels with pins, screen packs, rolls, rams, helical rotors, or combinations comprising at least one of the foregoing. Exemplary mixing devices are extruders such as single screw and twin screw extruders, buss kneaders, helicones, Eirich mixers, Waring blenders, Henschel mixers, or the like.

The magnetorheological fluid can be advantageously used in any controllable device such as dampers, mounts, clutches, brakes, valves and similar devices. These magnetorheological devices include a housing or chamber that contains the magnetorheological fluid. The fluid is particularly suitable for use in devices that require exceptional durability such as dampers. In a preferred embodiment, the MR fluid composition is used in a clutch assembly to control the fluid coupling between two rotating members. The change in yield stress from the MR fluid composition is relatively rapid, e.g., on the order of milliseconds, and is reversible. Since the magnetic field can be rapidly controlled by the application of current to the field coil, the yield stress of the fluid and thus the clutch torque can be changes just as rapidly.

EXAMPLES

Figure 3:
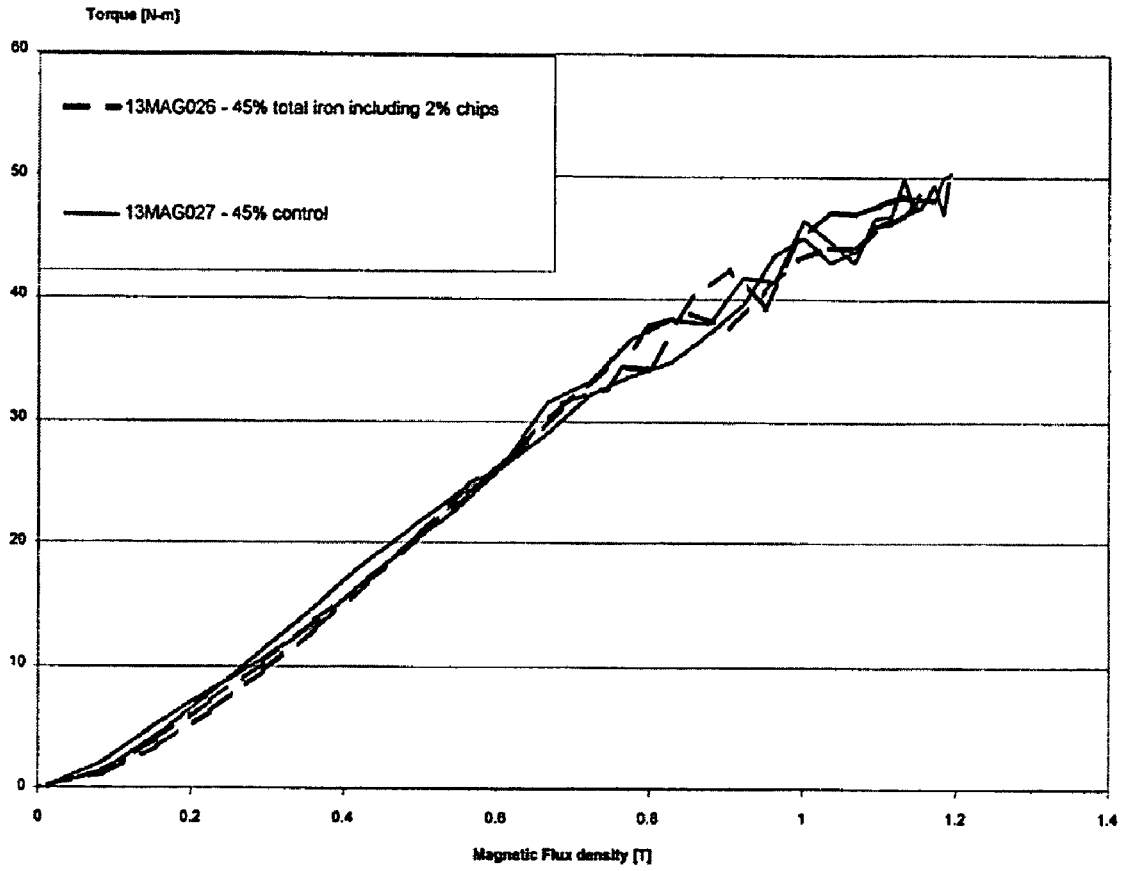
FIG. 3 graphically illustrates torque as a function of magnetic flux density for a MR fluid composition in accordance with the present disclosure relative to a control consisting of low aspect ratio magnetizable particles.

In this example, MR fluid compositions were prepared and the yield stress as a function of magnetic flux density was measured in a magnetic rheometer. FIG. 3 graphically illustrates the results. The solid represents a prior art MR fluid composition and the dotted line represents an MR fluid composition in accordance with the present disclosure. The prior art MR fluid composition consisted of low aspect ratio magnetizable particles formed from carbonyl iron having an aspect ratio of about 1 at a particle volume fraction of 45%. The MR fluid composition in accordance with the present disclosure was at the same particle volume fraction of 45% and consisted of 43% of the low aspect ratio magnetizable particles and 2% of high aspect ratio magnetizable particles (machine chips of cast iron).

The results indicate that the yield stress was essentially the same between the control and the MR fluid composition comprising the high and low aspect ratio particles. By using the machining chips of cast iron, a significant reduction in cost is obtained without any sacrifice in yield stress.

While the disclosure has been described with reference to exemplary embodiments, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the invention not be limited to the particular embodiment disclosed as the best mode contemplated for carrying out this disclosure.

What is claimed is:

1. A magnetorheological fluid composition comprising:

a low aspect ratio magnetizable particle comprising an aspect ratio from 1 to less than 1.5;

a high aspect ratio magnetizable particle comprising an aspect ratio greater than 1.5, a length from 1 to 10 millimeters and a diameter of 0.1 to 1 mm; and a carrier fluid.

2. The composition of claim 1, wherein the low aspect ratio magnetizable particles are spherical, ellipsoidal, conical, cuboidal, or polygonal.

3. The composition of claim 1, wherein the low aspect ratio magnetizable particles have an average particle size of about 0.1 micrometers to about 500 micrometers.

4. The composition of claim 1, wherein the high aspect ratio magnetizable particles comprise whiskers, needles, rods, chips, tubes, strands, elongated platelets, lamellar platelets, ellipsoids, wires, or a combination comprising at least one of the foregoing.

5. The composition of claim 1, wherein the high aspect ratio magnetizable particles comprise cross sectional geometries that are square, rectangular, triangular, circular, elliptical, polygonal, or a combination comprising at least one of the foregoing geometries.

6. The composition of claim 1, wherein the carrier fluid comprises a synthetic hydrocarbon based oil.

7. The composition of claim 1, further comprising a fumed silica.

8. The composition of claim 1, wherein the high aspect ratio magnetizable particles and the low aspect ratio magnetizable particles are manufactured from iron, iron oxide, iron nitride, iron carbide, carbonyl iron, chromium dioxide, low carbon steel, silicon steel, nickel, cobalt, iron oxides that contain small amounts of manganese, zinc or barium; alloys of iron that contain aluminum, silicon, cobalt, nickel, vanadium, molybdenum, chromium, tungsten, manganese, copper, or a combination comprising at least one of the foregoing metals; iron-cobalt alloys having an iron to cobalt ratio ranging from about 30:70 to about 95:5; iron-nickel alloys having an iron to nickel ratio ranging from about 90:10 to about 99:1; or a combination comprising at least one of the foregoing.

9. The composition of claim 1, wherein the weight ratio of the high aspect ratio magnetizable particles to the low aspect ratio magnetizable particles is about 1:100 to about 100:1.

10. The composition of claim 2, wherein the carrier fluid is at about 50 to about 95 volume percent based upon the total volume of the magnetorheological fluid composition.

11. The composition of claim 1, wherein the composition has a viscosity of about 1 to about 1,000 Pascal-seconds at 40° C. in an off-state.

12. The composition of claim 1, wherein the low aspect ratio magnetizable particle is spherical and has an aspect ratio of about 1.

13. A magnetorheological fluid composition comprising:

a low aspect ratio magnetizable particle comprising a bimodal particle distribution and an aspect ratio from 1 to less than 1.5;

a high aspect ratio magnetizable particle comprising an aspect ratio greater than 1.5, a length from 1 to 10 millimeters and a diameter of 0.1 to 1 mm;

a fumed silica; and a carrier fluid.

14. The composition of claim 13, wherein the low aspect ratio magnetizable particle is spherical and has an aspect ratio of about 1.

15. The composition of claim 13, further comprising a thixotropic agent, a carboxylate soap, an antioxidant, a lubricant, a viscosity modifier, a sulfur-containing compound or a combination comprising at least one of the foregoing additives in an amount of about 0.25 to about 10 volume percent, based upon the total volume of the magnetorheological fluid composition.

16. The composition of claim 13, wherein the composition has a viscosity of about 1 to about 1,000 Pascal-seconds at 40° C. in an off-state.

17. The composition of claim 13, wherein the high aspect ratio magnetizable particles and the low aspect ratio magnetizable particles are manufactured from iron, iron oxide, iron nitride, iron carbide, carbonyl iron, chromium dioxide, low carbon steel, silicon steel, nickel, cobalt, iron oxides that contain small amounts of manganese, zinc or barium; alloys of iron that contain aluminum, silicon, cobalt, nickel, vanadium, molybdenum, chromium, tungsten, manganese, copper, or a combination comprising at least one of the foregoing metals; iron-cobalt alloys having an iron to cobalt ratio ranging from about 30:70 to about 95:5; iron-nickel alloys having an iron to nickel ratio ranging from about 90:10 to about 99:1; or a combination comprising at least one of the foregoing.

18. The composition of claim 13, wherein the high aspect ratio magnetizable particles and the low aspect ratio magnetizable particles are at a weight ratio about 1:100 to about 100:1, respectively.

19. The composition of claim 13, wherein the carrier fluid comprises natural fatty oils, mineral oils, poly-alpha olefins, polyphenylethers, polyesters, perfluorinated polyesters, dibasic acid esters, neopentylpolyol esters, phosphate esters, synthetic cycloparaffin oils, synthetic paraffin oils, unsaturated hydrocarbon oils, monobasic acid esters, glycol esters, glycol ethers, synthetic hydrocarbon oils, perfluorinated polyethers, halogenated hydrocarbons, or a combination comprising at least one of the foregoing carrier fluids.

* * * * *